US006029313A

United States Patent [19]

O'Dea et al.

[11] Patent Number: 6,029,313

[45] Date of Patent: Feb. 29, 2000

[54] VACUUM CLEANER WITH CANTILEVERED DRIVE SYSTEM AND REMOVABLE BELT ACCESS DOOR

[75] Inventors: Kevin J. O'Dea, Southbury; Maurice Anthony Melito, East Haven, both of Conn.; Michael Kin-Chung Ho, Shau Kei Wan, The Hong Kong Special Administrative Region of the People's Republic of China

[73] Assignee: Black & Decker, Inc., Newark, Del.

[21] Appl. No.: 08/751,092

[22] Filed: Nov. 15, 1996

[51] Int. Cl.[7] ..... A47L 5/10

[52] U.S. Cl. ..... 15/391

[58] Field of Search ..... 15/339, 389, 391

[56] References Cited

U.S. PATENT DOCUMENTS

| | | | |
|---|---|---|---|
| 2,657,417 | 11/1953 | Howard | 15/391 |
| 2,740,984 | 4/1956 | Holt . | |
| 3,120,021 | 2/1964 | Pauler et al. . | |
| 3,148,400 | 9/1964 | Worwag . | |
| 3,892,003 | 7/1975 | Peabody | 15/49 C |
| 4,375,117 | 3/1983 | Lyman | 15/377 |
| 4,392,271 | 7/1983 | Sepke | 15/339 |
| 4,977,640 | 12/1990 | Hirano et al. | 15/339 |
| 5,165,140 | 11/1992 | Ide | 15/392 |

FOREIGN PATENT DOCUMENTS

| | | |
|---|---|---|
| 0 338 513 A2 | 10/1989 | European Pat. Off. . |
| 0 437 109 A2 | 7/1991 | European Pat. Off. . |
| 529 132 | 7/1931 | Germany . |
| 928 548 | 6/1955 | Germany . |
| M7522064 U | 1/1976 | Germany . |

*Primary Examiner*—Diana Oleksa
*Attorney, Agent, or Firm*—Ajay K. Gambhir

[57] ABSTRACT

A vacuum cleaner with a handle and a floor traveling head. The head has a housing, a rotatable brush and a drive system. The housing has a bottom member with an aperture directly under a transmission belt of the drive system. A removable door is mounted to the bottom member such that a user can access the transmission belt without removing the bottom member.

19 Claims, 2 Drawing Sheets

FIG. 1
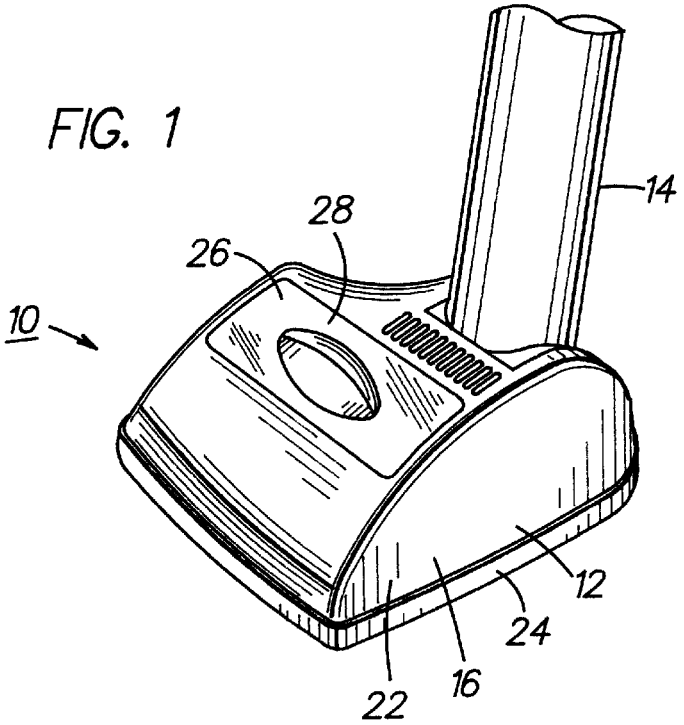
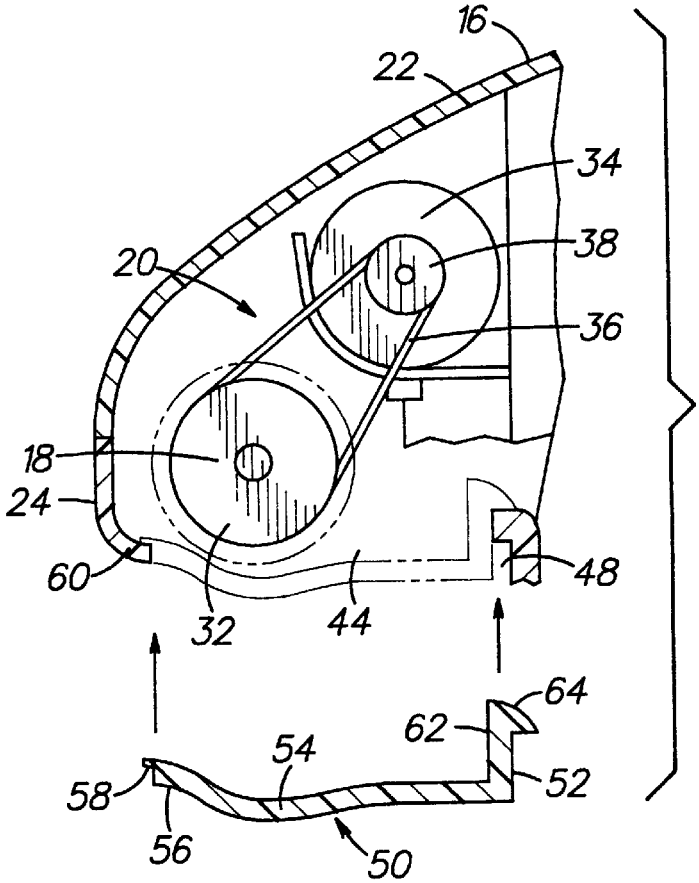
FIG. 3

VACUUM CLEANER WITH CANTILEVERED DRIVE SYSTEM AND REMOVABLE BELT ACCESS DOOR

BACKGROUND OF THE INVENTION

1. Field of the Invention

The present invention relates to vacuum cleaners and, more particularly, to a vacuum cleaner with a rotatable brush.

2. Prior Art

U.S. Pat. Nos. 4,375,117; 4,392,271; 4,977,640 and 5,165,140 disclose vacuum cleaners with motor driven brushes and cantilevered belt drive systems. U.S. Pat. No. 3,120,021 discloses a bottom cover plate mounted to a casing by a spring clip. Black & Decker (U.S.) Inc. has a hand-held vacuum cleaner with a cantilevered brush drive system and an access cover that has four screws attaching the cover to the housing.

SUMMARY OF THE INVENTION

In accordance with one embodiment of the present invention, a vacuum cleaner is provided comprising a floor traveling head with a housing, a brush rotatably mounted to the housing, and a motor connected to the brush by a transmission belt. The housing has an aperture located directly under the transmission belt. A door is movably connected to the housing in the aperture. The door can be moved to gain access to the transmission belt without disassembling the housing.

In accordance with another embodiment of the present invention, a vacuum cleaner is provided having a handle and a floor traveling head. The head comprises a housing, a brush, and a drive system. The housing has a bottom frame member fixedly connected to a top frame member. The brush is rotatably connected to the bottom frame member. The brush has a cantilevered drive section at one end. The bottom frame member has an aperture directly below the belt and the cantilevered drive section. A door is removably mounted in the aperture such that a user can gain access to the belt by removing the door without disassembling the bottom frame member from the top frame member.

BRIEF DESCRIPTION OF THE DRAWINGS

The foregoing aspects and other features of the invention are explained in the following description, taken in connection with the accompanying drawings, wherein:

FIG. 1 is a partial perspective view of a vacuum cleaner incorporating features of the present invention;

FIG. 3 is a partial schematic cross sectional view of the front of the vacuum cleaner shown in FIG. 2 taken along line 3—3.

DETAILED DESCRIPTION OF THE PREFERRED EMBODIMENT

Figure 2:
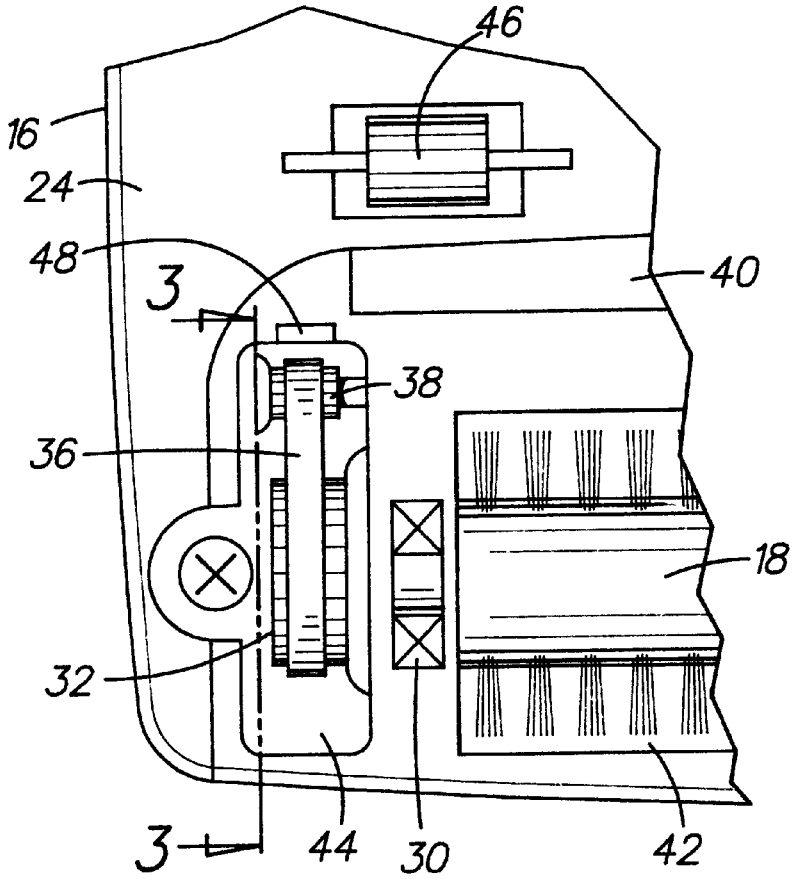
FIG. 2 is a partial plan bottom view of the front left of the vacuum cleaner shown in FIG. 1.

Referring to FIG. 1, there is shown a partial perspective view of a vacuum cleaner 10 incorporating features of the present invention. Although the present invention will be described with reference to the single embodiment shown in the drawings, it should be understood that features of the present invention could be embodied in many different forms of alternate embodiments. Features of the present invention could be embodied in various different types of vacuum cleaners. In addition, any suitable size, shape or type of elements or materials could be used.

Figure 4:
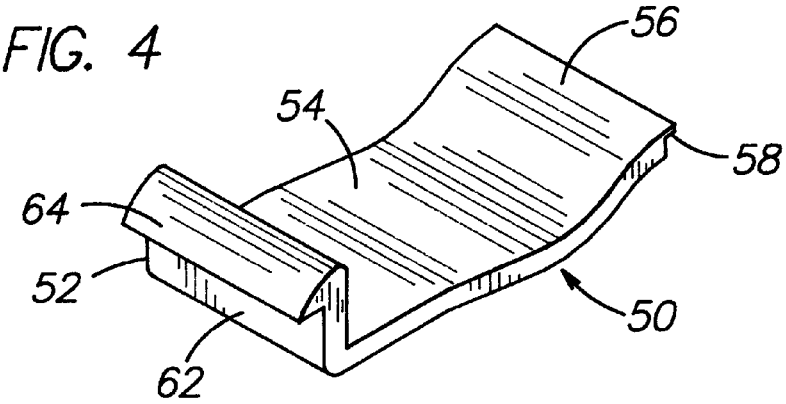
FIG. 4 is a perspective view of the door shown in FIG. 2.

Referring also to FIGS. 2–4, the vacuum cleaner 10 includes a floor traveling head 12 and a handle 14. The head 12 has a housing 16, a brush 18 and a brush drive system 20. The housing 16 has a general clamshell configuration with a top frame member 22 and a bottom frame member 24. The two frame members 22, 24 form substantially the entire housing and enclose working components, such as the vacuum motor and impeller, therebetween. A dirt collection cup 26 is removably mounted to the housing 16 with its top side 28 at the top side of the top frame member 22. The bottom frame member 24 is preferably a one-piece member and forms substantially the entire bottom surface of the housing 16.

The brush 18 is rotatably mounted to the housing 16. The left end of the brush 18, as seen in FIG. 2, is mounted to the housing by a bearing 30. The right end of the brush 18 is also mounted to the housing 16 by another bearing (not shown). The two bearings are connected or captured between the top frame member 22 and the bottom frame member 24. The brush, with the bearings, nests into the bottom frame member and are secured by the top frame member. An end 32 of the brush 18 extends outwardly past the bearing 30 in a general cantilever fashion. The end 32 forms a drive section for the brush. The drive section end 32 is part of the drive system 20 for the brush 18. The drive system 20 further includes a motor 34 and a transmission belt 36. The belt 36 interconnects a pulley 38 on the motor 34 to the cantilevered end 32 of the brush 18.

The bottom frame member 24 includes a suction inlet 40, a bottom aperture 42 for the brush 18, and a bottom access aperture 44. Wheels 46 are mounted to the bottom frame member 24 for easier movement along the floor. The access aperture 44 has a general elongate rectangular shape and is located directly below the belt 36. A notch 48 is located at the rear side of the access aperture 44.

Located in the access aperture 44 is a door 50. The door 50 is removably connected to the bottom frame member 24. The door 50 includes a rear end 52, a main section 54, and a front end 56. As seen in FIG. 3, the door 50 has a general cross-sectional L-shape. The front end 56 has a ledge 58. As shown by dotted lines in FIG. 3, the ledge 58 interacts with the front edge 60 of the access aperture 44 to help mount the door to the bottom frame piece 24. The rear end 52 has an upstanding leg 62 and a snap lock latch 64. The leg 62 is resilient to allow the latch 64 to resiliently deflect relative to the main section 54. Thus, the front end 56 can be positioned against the front edge 60 and the rear end 52 snap-locked into place at the rear end of the access aperture 44. The notch 48 allows a user to insert a tool, such as a screw driver, between the leg 62 and the rear end of the access aperture 44 for deflecting the leg 62 to remove the door 50 after it has been connected. In an alternate embodiment, the door could be pivotably or slidably mounted to the bottom frame member. Other alternatives could include a side opening door or any other type of door. In addition, the door could be used with a vacuum cleaner having any suitable type of brush drive system.

The cantilevered brush drive system and access door described above allows the transmission belt to be serviced and/or replaced without involving disassembly of the brush assembly or the housing frame pieces. The embodiment described above requires less time to service the belt because it involves less disassembly than in other vacuum cleaners. It also reduces the chance of misassembly because fewer parts are involved. The brush assembly, housing frame members and their fasteners not involved in the disassembly.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. In a vacuum cleaner having a floor traveling head with a housing, a brush rotatably mounted to the housing, and a motor connected to the brush by a transmission belt, wherein the improvement comprises:

the housing having an aperture located directly under the transmission belt only under an immediate vicinity of the transmission belt and a door movably connected to the housing in the aperture, wherein the door can be moved to gain access to the transmission belt without disassembling the housing.

2. A vacuum cleaner as in claim 1 wherein the door is removably mounted in the aperture.

3. A vacuum cleaner as in claim 1 wherein the door has a first end with a snap lock ledge.

4. A vacuum cleaner as in claim 3 wherein the door has an opposite second end with a retaining ledge.

5. A vacuum cleaner as in claim 3 wherein the first end is deflectable relative to a main portion of the door.

6. A vacuum cleaner as in claim 1 wherein the brush has a cantilevered end with the transmission belt mounted thereon.

7. A vacuum cleaner as in claim 1 wherein the aperture is located only outward from a rotatable mount of the brush to the housing.

8. In a vacuum cleaner having a floor traveling head with a housing, a brush rotatably mounted to the housing, and a motor connected to the brush by a transmission belt, wherein the improvement comprises:

the housing having a generally elongated rectangular shaped aperture located directly under the transmission belt and a door movably connected to the housing in the aperture, wherein the door can be moved to gain access to the transmission belt without disassembling the housing.

9. In a vacuum cleaner having a floor traveling head with a housing, a brush rotatably mounted to the housing, and a motor connected to the brush by a transmission belt, wherein the improvement comprises:

the housing having an aperture located directly under the transmission belt and a generally cross-sectional L-shaped door movably connected to the housing in the aperture, wherein the door can be moved to gain access to the transmission belt without disassembling the housing.

10. A vacuum cleaner having a handle and a floor traveling head, the head comprising:

a housing with a bottom frame member fixedly connected to a top frame member;

a brush rotatably connected to the bottom frame member, the brush having a cantilevered drive section at one end; and a drive system with a belt connected to the cantilevered drive section for rotating the brush;

wherein the bottom frame member has an aperture directly below the belt and the cantilevered drive section, and a door is removably mounted in the aperture such that a user can gain access to the belt by removing the door without disassembling the bottom frame member from the top frame member.

11. A vacuum cleaner as in claim 10 wherein the door has a first end with a snap lock ledge.

12. A vacuum cleaner as in claim 11 wherein the door has an opposite second end with a retaining ledge.

13. A vacuum cleaner as in claim 11 wherein the first end is deflectable relative to a main portion of the door.

14. A vacuum cleaner as in claim 10 wherein the aperture is located only under an immediate vicinity of the belt.

15. A vacuum cleaner as in claim 14 wherein the aperture is located only outward from a rotatable mount of the brush to the housing.

16. A vacuum cleaner as in claim 10 wherein the aperture has a general elongate rectangular shape.

17. A vacuum cleaner as in claim 10 wherein the door has a general cross-sectional L-shape.

18. A vacuum cleaner as in claim 10 wherein the bottom frame member forms substantially an entire bottom surface of the housing.

19. A vacuum cleaner as in claim 18 wherein the bottom frame member is a single one-piece member.

* * * * *